US006401681B1

(12) United States Patent
Daikoku et al.

(10) Patent No.: US 6,401,681 B1
(45) Date of Patent: Jun. 11, 2002

(54) FOUR-CYCLE OUTBOARD MOTOR

(75) Inventors: Keisuke Daikoku; Masashi Takayanagi, both of Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/650,829

(22) Filed: Aug. 30, 2000

(30) Foreign Application Priority Data

Aug. 31, 1999 (JP) ..... 11-246808

(51) Int. Cl.[7] ..... F02F 7/00
(52) U.S. Cl. ..... 123/195 P; 440/88
(58) Field of Search ..... 123/195 P; 440/88

(56) References Cited

U.S. PATENT DOCUMENTS 5,616,058 A * 4/1997 Nakai ..... 123/195 P
5,769,675 A * 6/1998 Takahashi et al. ..... 440/83

FOREIGN PATENT DOCUMENTS

JP 02274691 A 4/1989
JP 04345592 A 12/1992
JP 05026175 A 2/1993
JP 07324659 A 12/1995
JP 08100614 A 4/1996
JP 10159532 A 6/1998
JP 10218090 A 8/1998

* cited by examiner

*Primary Examiner*—Noah P. Kamen
(74) *Attorney, Agent, or Firm*—Morrison Law Firm

(57) ABSTRACT

The present invention provides a four-cycle outboard motor (1),with reduced vibration and improved control stability. The center of gravity is moved forward allowing reduced size. In outboard motor (1), a crank shaft (4) is arranged substantially vertically within an engine (3) so that the rotational force of crank shaft (4) is transmitted to a propulsion unit via a drive shaft (10). The shaft centers of crankshaft 4 and drive shaft 10 are arranged either on an axis (31) of a cylinder constituting engine 3, or on the centerline of engine (3), which extends in the fore-aft direction and passes through the shaft center of crankshaft (4), and in that the shaft center of drive shaft (10) is arranged offset toward the rear of outboard motor (1) from the shaft center of crankshaft (4).

18 Claims, 6 Drawing Sheets

FOUR-CYCLE OUTBOARD MOTOR

BACKGROUND OF THE INVENTION

This application incorporates by reference the disclosures of co-pending patent applications Ser. No. 09/651,688 by Masashi Takayanagi entitled "Four-Cycle Outboard Motor" and Ser. No. 09/651,452 by Jun Itoh entitled "Engine Holder Structure for Four-Cycle Outboard Motor", each of which is filed concurrently with the present application and is assigned to the assignee of the present application.

1. Field of the Invention

The present invention relates to a four-cycle outboard motor.

2. Description of the Related Art

The engine used in an outboard motor is generally a vertical-type engine, in which a crankshaft is arranged vertically. A drive shaft for transmitting the rotational force of the crankshaft to a propeller is arranged coaxially with the crankshaft such that the drive shaft is directly connected to the crankshaft.

Further, the engine layout is typically such a configuration that, with the vertical crankshaft crossing the center line along the fore-aft direction of the outboard motor, a crankcase is arranged on the front side (may be referred to "front") of the outboard motor and that a cylinder head is arranged on the rear side (may be referred to "rear"), respectively.

Furthermore, in the case of a four-cycle engine, a pulley or sprocket is disposed on the crankshaft so that a valve camshaft is driven by way of a belt or chain. The pulley or sprocket disposed on the crankshaft is generally arranged between a bearing at the uppermost portion of the crankshaft and a flywheel disposed at the top end of the crankshaft.

However, when the crankcase and the cylinder head are arranged on the front side and on the rear side of the outboard motor, respectively with the crankshaft crossing the center line along the fore-aft direction of the outboard motor, the center of gravity is located toward the rear of the outboard motor. This biased position of the center of gravity is especially toward the rear in the case of a four-cycle engine since a valve mechanism is provided in the cylinder head.

An outboard motor is typically mounted to a hull by way of a mounting device so that it is constituted to be able to steer to the left or the right by turning itself around a pilot shaft (outboard motor's axis of rotation). However, the control stability becomes less when the center of gravity of an outboard motor recedes farther from the pilot shaft.

Further, since the mounting device is attached to the outboard motor by way of a mounting unit, vibration may be increased if the center of gravity of the outboard motor recedes farther from the mounting unit.

Meanwhile, in the case of a four-cycle engine, because the rotational speed ratio of the crankshaft and camshaft is 2 to 1, the ratio of the numbers of teeth (circumference) of the sprocket (pulley) disposed on the crankshaft and the sprocket (pulley) disposed on the camshaft is 1 to 2. Thus, because the diameter of the sprocket (pulley) disposed on the camshaft is univocally determined by the diameter of the sprocket (pulley) disposed on the crankshaft, there is a limit to decreasing the diameter of the sprocket (pulley) disposed on the camshaft. Due to this limitation, it is not easy to reduce the size of the valve mechanism of an engine having two camshafts.

Furthermore, when a camshaft drive sprocket (pulley) is arranged between the uppermost bearing of the crankshaft and the flywheel, the engine is apt to vibrate due to the large inertial mass of the flywheel disposed at the top end of the crankshaft.

The present invention was made in view of the above situation, and it is an object of the present invention to provide a four-cycle outboard motor where vibration is reduced, where control stability is improved, and where the overall outboard motor is more compact, by moving the location of the center of gravity toward the front.

Another object of the present invention is to provide a four-cycle outboard motor in which a valve apparatus is more compact.

SUMMARY OF THE INVENTION

The present invention satisfies the above-described needs by providing a four-cycle outboard motor having a crankshaft arranged substantially vertically within an engine so that the rotational force of this crankshaft is transmitted to a propulsion unit via a drive shaft, the four-cycle outboard motor being characterized in that the shaft centers of the above-mentioned crankshaft and the above-mentioned drive shaft are arranged, in the plan view, either on an axis of a cylinder constituting the above-mentioned engine or on the center line of the engine, which extends in the fore-aft direction of the above-mentioned outboard motor and passes through the shaft center of the above-mentioned crankshaft, and in that the shaft center of the above-mentioned drive shaft is arranged so as to be offset toward the rear of the above-mentioned outboard motor from the shaft center of the above-mentioned crankshaft.

Further, it is another object of the present invention to provide a four-cycle outboard motor having a crankshaft arranged substantially vertically within an engine so that the rotational force of this crankshaft is transmitted to a propulsion unit via a drive shaft, of which the shaft center is arranged so that it is disposed offset from the shaft center of the above-mentioned crankshaft toward the rear of the above-mentioned outboard motor, the four-cycle outboard motor being characterized in that a rotational force transmitting member such as sprocket and pulley for driving the valve camshaft is arranged lower than the axis of the bottommost cylinder constituting the above-mentioned engine, and in that the above-mentioned rotational force transmitting member is arranged coaxially with the above-mentioned drive shaft.

Furthermore, it is another object of the present invention to provide a the four-cycle outboard motor having the shaft centers of the above-mentioned crankshaft and the above-mentioned drive shaft arranged, in the plan view, either on an axis of a cylinder constituting the above-mentioned engine or on the center line of the engine, which extends in the fore-aft direction of the above-mentioned outboard motor and passes through the shaft center of the above-mentioned crankshaft.

And furthermore, it is another object of the present invention to provide a four-cycle outboard motor having a first rotational force transmitting member (valve camshaft driving sprocket or pulley), which is arranged coaxially with the above-mentioned drive shaft, and a second rotational force transmitting member (valve camshaft driving sprocket or pulley), which is disposed on the above-mentioned valve camshaft, with the speed conversion ratio of the first rotational force transmitting member and the second rotational force transmitting member set less than 2 to 1 (or 2/1). The speed conversion ratio, for example, may be defined by a ratio (n1/n2) of the number (n1) of teeth of a valve camshaft driving sprocket arranged on the valve camshaft and the number (n2) of teeth of a valve camshaft driving sprocket arranged coaxially with the drive shaft if sprockets are employed.

Further, it is another object of the present invention to provide a four-cycle outboard motor having at least two valve camshafts: one for intake and one for exhaust.

Still further, it is another object of the present invention to provide a four-cycle outboard motor having a crankshaft and a drive shaft, which are connected by way of connecting means, the outboard motor further comprising a crank gear disposed on the bottom end of the crankshaft and a driven gear, with which the crank gear engages, wherein the driven gear is integrally formed into the connecting means and wherein a first rotational force transmitting member (valve camshaft driving sprocket or pulley) is integrally formed with the connecting means.

Further, it is another object of the present invention to provide the above-mentioned four-cycle outboard motor having the first rotational force transmitting member (valve camshaft driving sprocket or pulley) for driving the valve camshaft arranged below the driven gear.

Furthermore, it is another object of the present invention to provide the above-mentioned four-cycle outboard motor having the first rotational force transmitting member (valve camshaft driving sprocket or pulley) for driving the valve camshaft arranged above the driven gear.

And then, it is another object of the present invention to provide the above-mentioned the four-cycle outboard motor wherein the crank gear is pressed onto the bottom end of the crankshaft.

DETAILED DESCRIPTION OF THE PREFERRED EMBODIMENT

Embodiments of the present invention will be explained below with reference to the figures.

Figure 1:
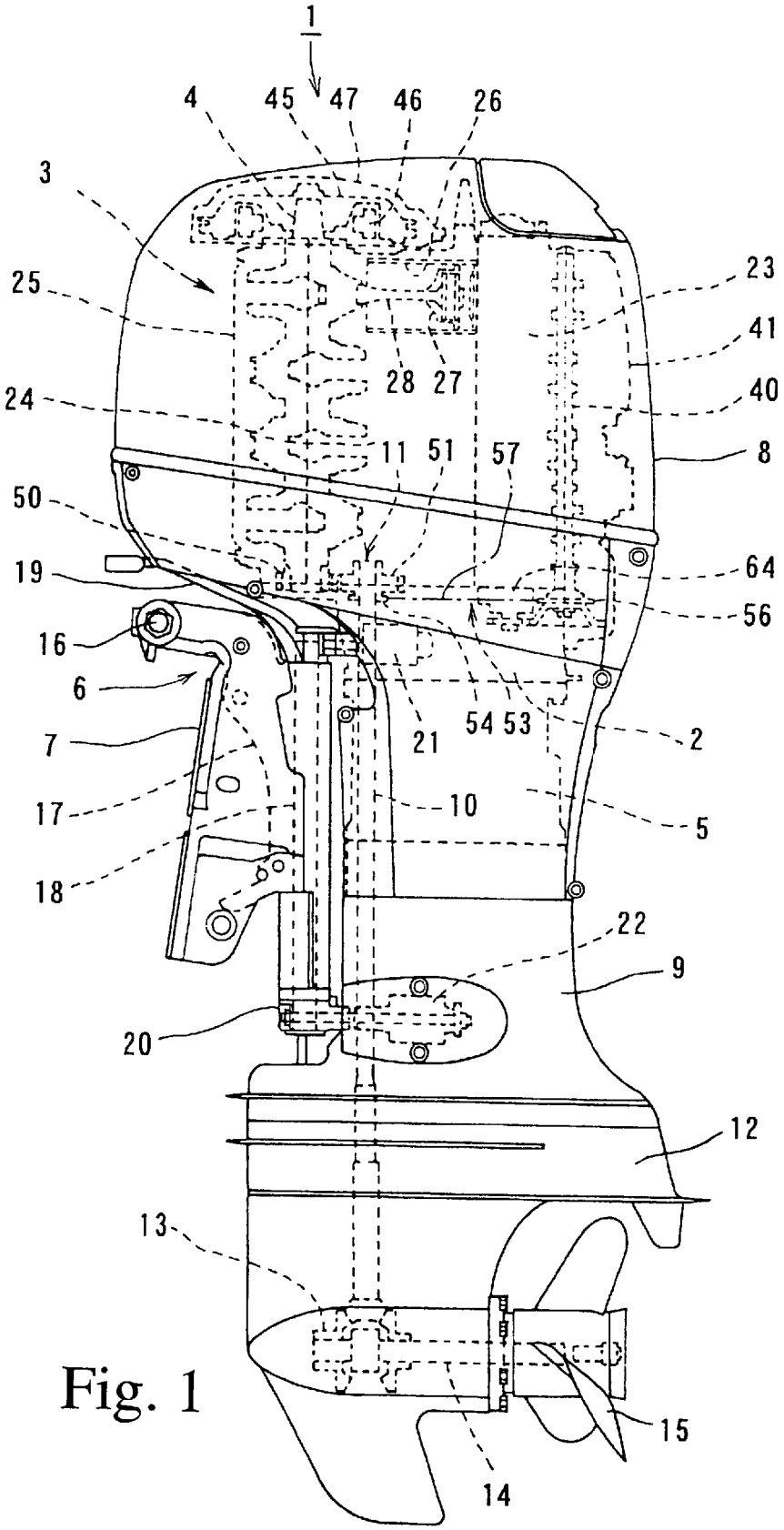
FIG. 1 is a left side view of an outboard motor showing an embodiment of a four-cycle outboard motor according to the present invention.

FIG. 1 is a left side view showing an embodiment of an outboard motor according to the present invention. As FIG. 1 shows, this outboard motor 1 is equipped with an engine holder 2, and an engine 3 installed above this engine holder 2. This engine 3 is a vertical-type engine having a crankshaft 4 disposed substantially vertically in the interior thereof.

An oil pan 5 is disposed below the engine holder 2. A clamp bracket 7 is, for example, attached via a mounting device 6 to the outboard motor 1. The outboard motor 1 is mounted to a transom in the hull (not illustrated) via this clamp bracket 7. Also, the engine 3, the engine holder 2 and the oil pan 5 of this outboard motor 1 are covered all over by an engine cover 8.

A drive shaft housing 9 is disposed below the oil pan 5. A drive shaft 10 is disposed substantially vertically inside the engine holder 2, the oil pan 5 and a drive shaft housing 9. The upper end of the drive shaft housing 9 is linked to the lower end of the crankshaft 4 via a connecting means (or linking means) 11. The drive shaft 10 extends downward through the interior of drive shaft housing 9 and is configured so as to drive a propeller (propulsion device) 15, which is a propelling device, via a bevel gear 13 and a propeller shaft 14 inside a gear case 12 provided below the drive shaft housing 9.

The above-mentioned clamp bracket 7 is provided with a swivel bracket 17 via a tilt shaft 16, and a pilot shaft 18 is pivoted vertically and with rotational freedom inside this swivel bracket 17. An upper mount bracket 19 and a lower mount bracket 20, which also serve as steering brackets, are provided rotationally integrally at the top and bottom ends of this pilot shaft 18.

A pair of left and right upper mounting units 21 are provided at the front part of the engine holder 2, and are connected to the upper mounting bracket 19. Also, a pair of lower mounting units 22 are provided on the opposite sides of the drive shaft housing 9, and are connected to the lower mount bracket 20. A mounting device 6 is then configured in the above way, and the outboard motor 1 becomes capable of steering to the left or the right by turning itself around the pilot shaft 18 with respect to the clamp bracket 7, and becomes capable of tilting up around the tilt shaft 16.

Figure 2:
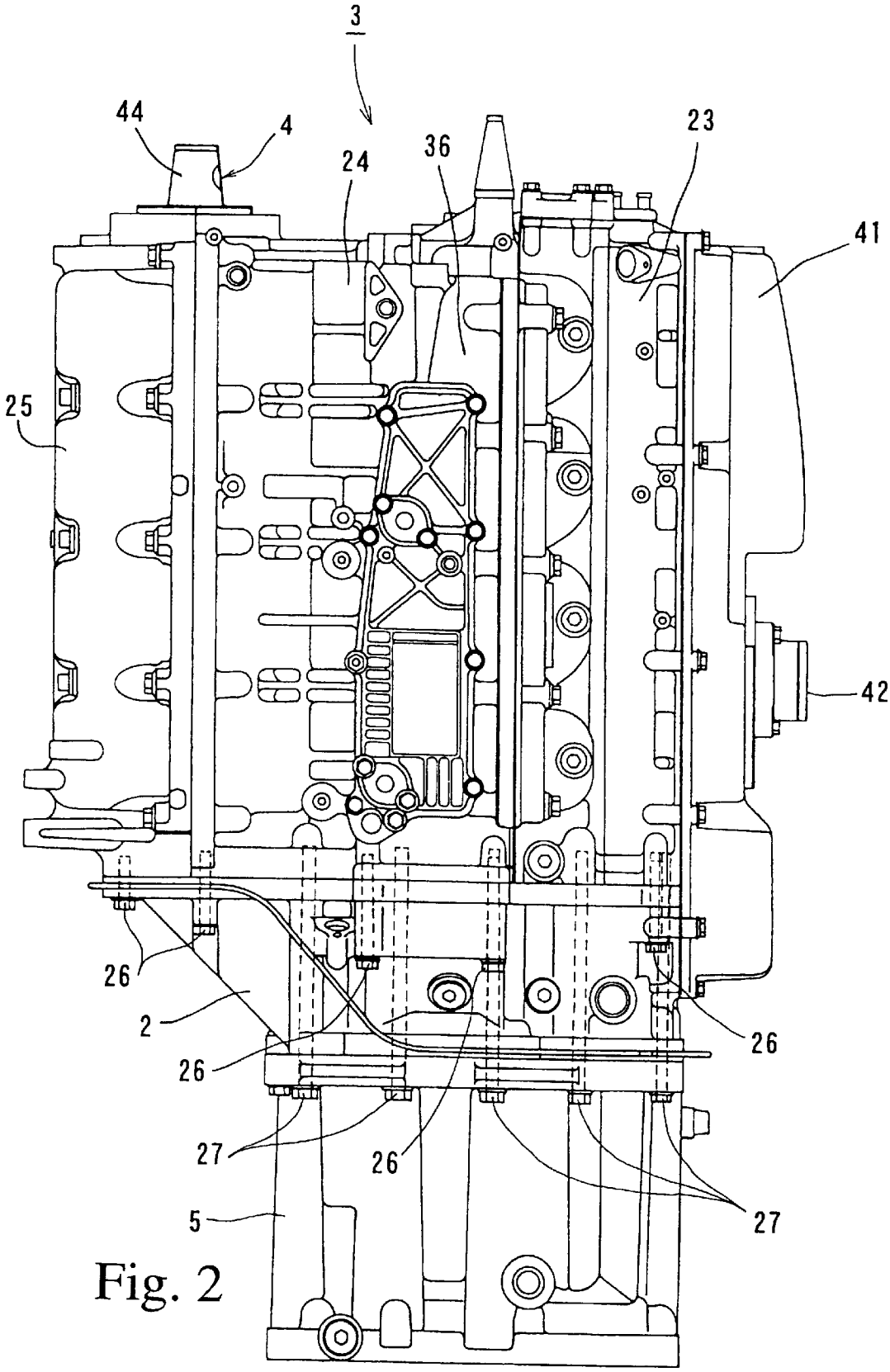
FIG. 2 is an enlarged left side view of the central portion of the outboard motor shown in FIG. 1.
Figure 3:
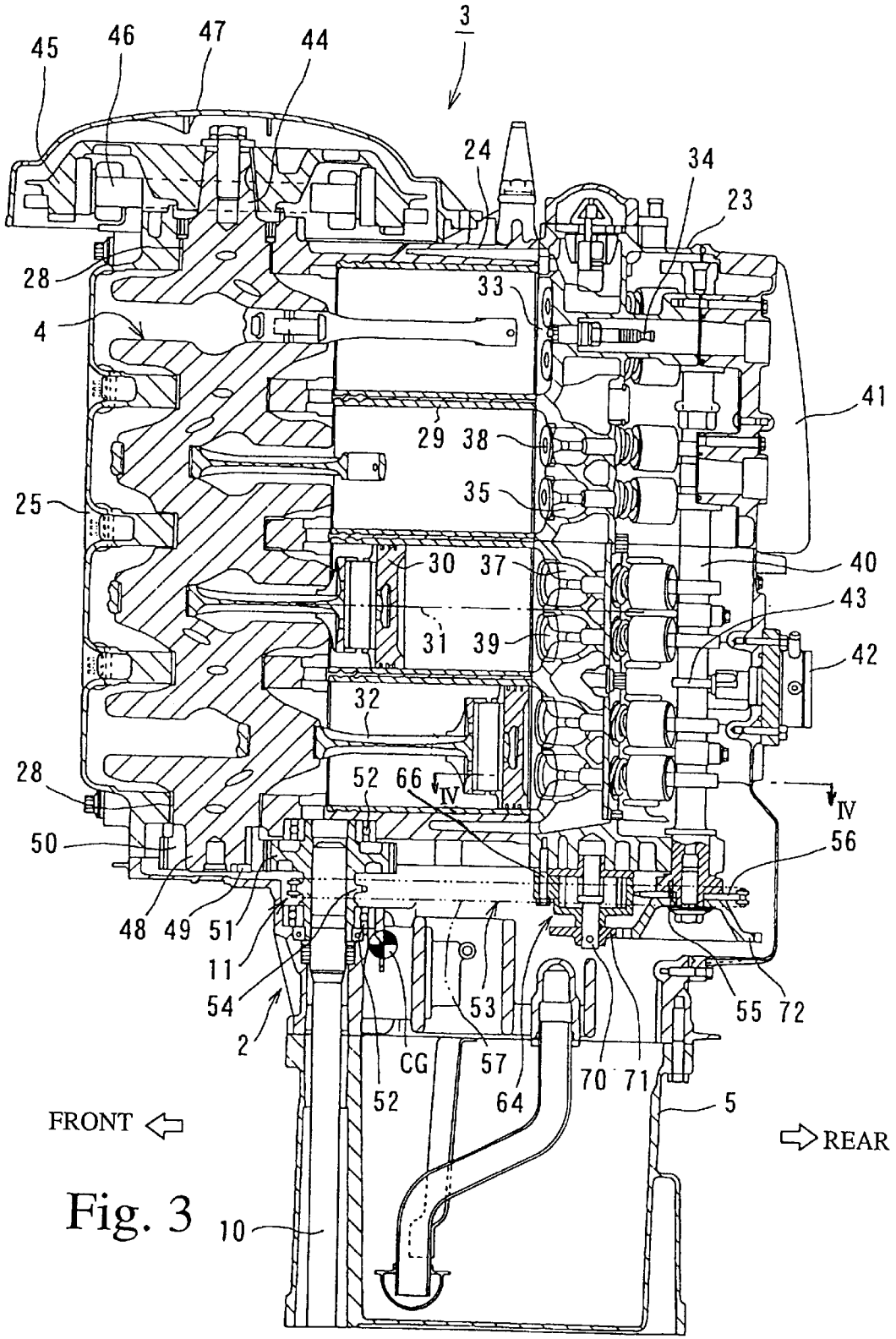
FIG. 3 is a vertical cross-sectional view of FIG. 2.
Figure 4:
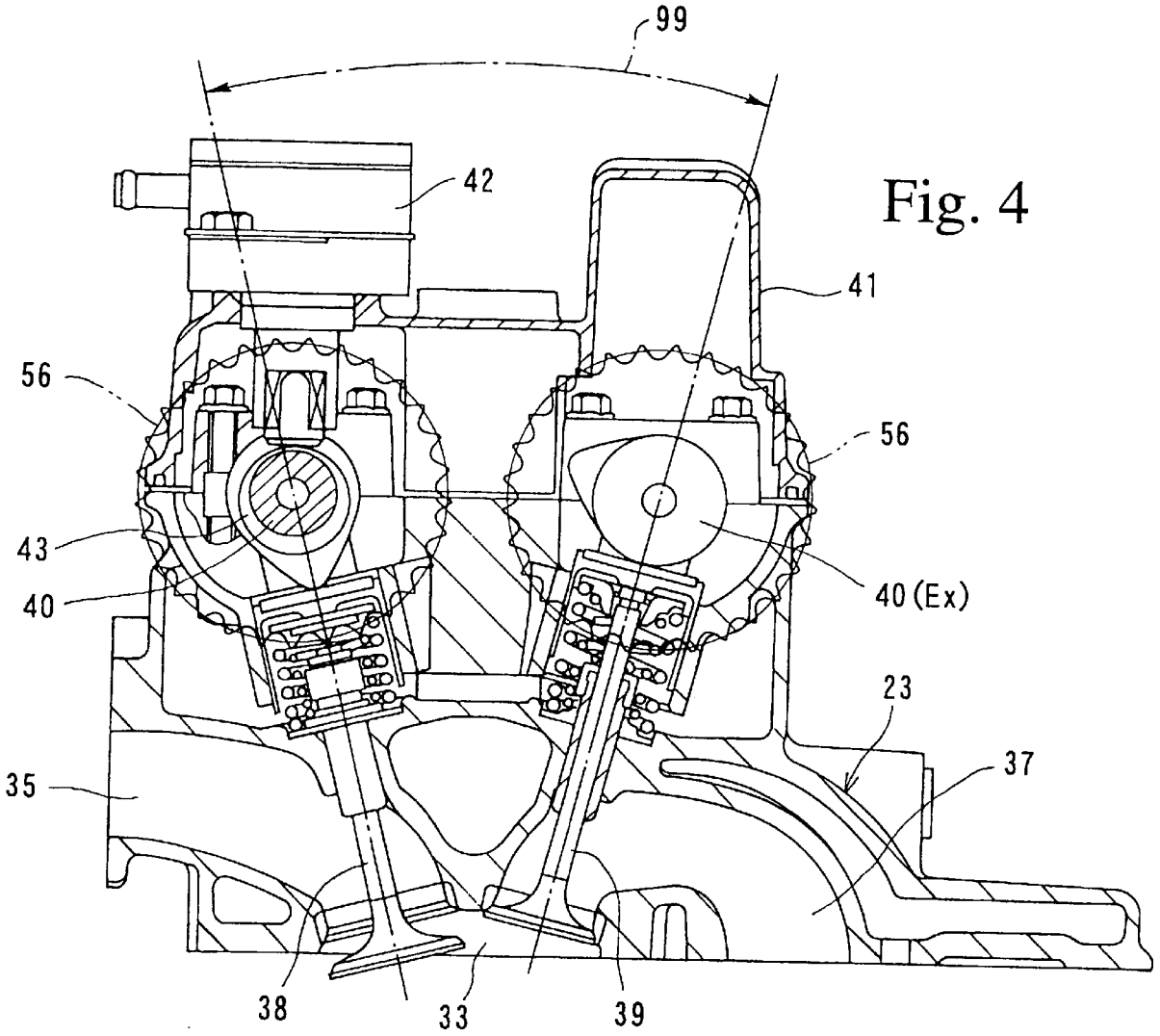
FIG. 4 is a cross-sectional view along line IV—IV of FIG. 3.

FIG. 2 shows an enlarged left side view of the central part of the outboard motor, and FIG. 3 shows a vertical cross section thereof shown in FIG. 2. Also, FIG. 4 shows a cross section along line IV—IV in FIG. 3. As FIGS. 2 and 3 show, the engine 3 mounted on this outboard motor 1 is a water-cooled four-cycle four-cylinder inline engine configured by assembling, for example, a cylinder head 23, a cylinder block 24, a crankcase 25 and so on.

The cylinder block 24 is disposed behind crankcase 25 (on the right side in FIG. 2 or the boat stem side) which is disposed at the frontmost part of engine 3 at the leftmost side (the bow side) in FIGS. 2 and 3. Also, the cylinder head 23 is disposed behind the cylinder block 24.

Figure 5:
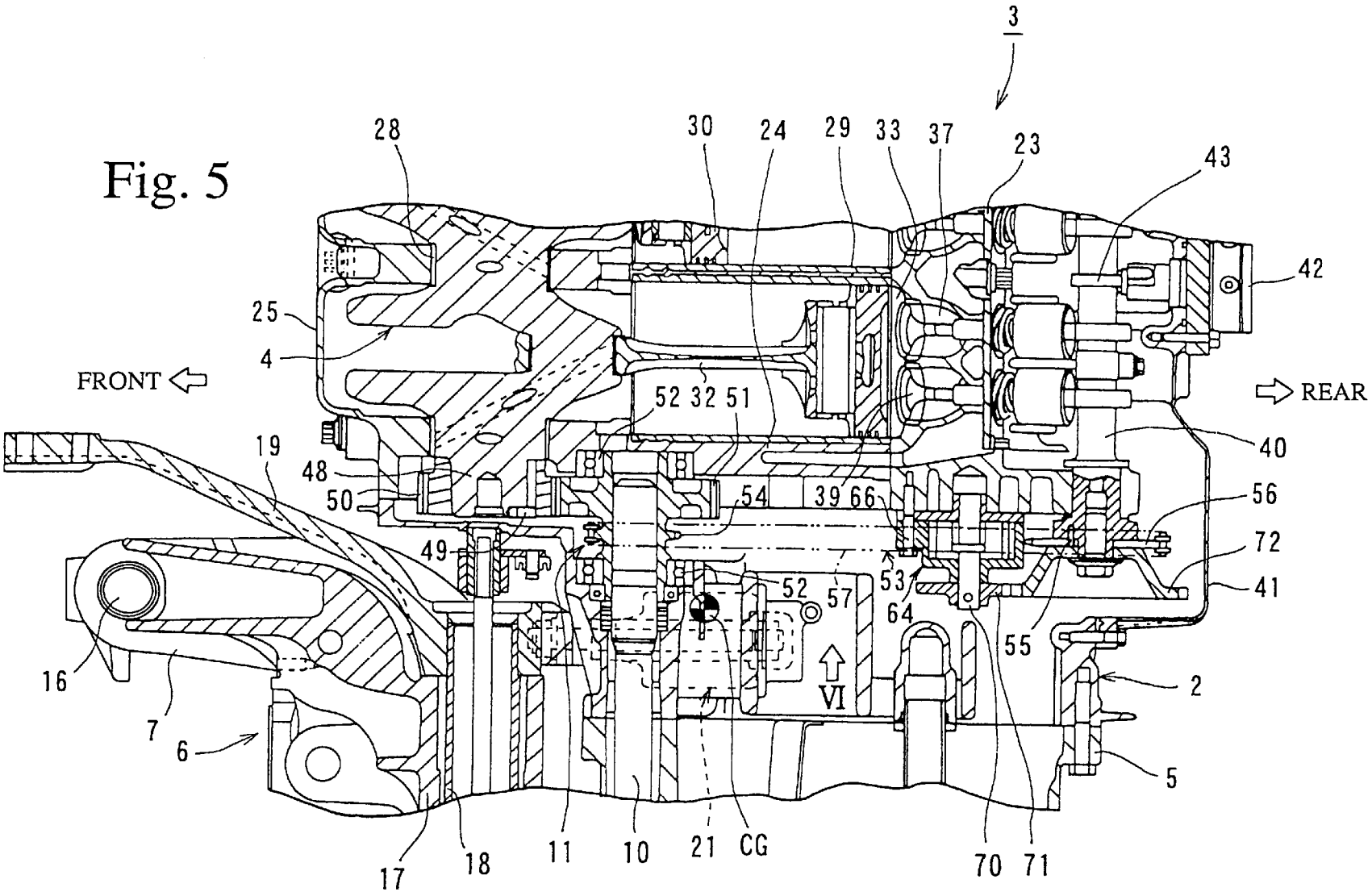
FIG. 5 is an enlarged vertical cross-sectional view of the engine holder and components in the vicinity thereof shown in FIG. 3.

As FIG. 2 shows, the lower surfaces of the cylinder head 23, the cylinder block 24 and the crankcase 25 are formed in the same plane and mounted on the upper surface of the engine holder 2. The cylinder head 23, the cylinder block 24 and the crankcase 25 are all securely fixed to the engine holder 2 by a plurality of bolts 26 inserted from the lower surface of the engine holder 2. Around the upper mounting units 21 which is provided at the front part of the engine holder 2 as mentioned before, the center of gravity (CG) of the outboard motor 1 is located as shown in FIGS. 3 and 5.

Furthermore, a plurality of bolts 27 pass through the engine holder 2 from below the oil pan 5 which is disposed under the engine holder 2, and extend, for example, into the lower parts of the cylinder head 23 and the cylinder block 24, whereby the engine holder 2 and the oil pan 5 are fastened together with and fixed to both cylinder head 23 and cylinder block 24.

The crankshaft 4 is pivoted substantially vertically at the interface between the crankcase 25 and the cylinder block 24, as described above, via a plurality of metal bearings 28, for example. Also, four cylinders 29 are formed approximately horizontally in the axes thereof and are aligned in a vertical direction inside the cylinder block 24. A piston 30 is inserted into each cylinders 29 with freedom to slide axially along the axis 31 of the each cylinder 29. Furthermore, the crankshaft 4 is linked to each piston 30 by a connecting rod 32, whereby the reciprocating stroke of the each piston 30 is converted into rotational motion of the crankshaft 4.

A combustion chamber 33 is formed in the cylinder head 23 for each cylinder 29 so that all cylinders have corresponding combustion chambers 33, in which spark plugs 34 are plugged from the outside so that the plugs may be connected to the outside. Also, air intake ports 35, which connect with combustion chambers 33, and exhaust ports 37, which connect with exhaust ducts 36 formed on the left side of the cylinder block 24 and the engine holder 2, are also formed inside the cylinder head 23. Furthermore, air intake valves 38 and exhaust valves 39 which open and close ports 35 and 37, respectively, are disposed inside the cylinder head 23, and two (air intake and exhaust) valve actuator camshafts 40 which open and close these valves 38 and 39, respectively, are disposed parallel with the crankshaft 4 in the rear part of the cylinder head 23.

The cylinder head 23 is covered by a cylinder head cover 41. A mechanical fuel pump 42 is disposed inside the cylinder head cover 41, and this fuel pump 42 is driven by a cam 43 provided on the camshaft 40.

Also, as shown in FIG. 3, the upper end of the crankshaft 4 projects from the top of the engine 3 (or the crank case 15 and the cylinder block 24). A flywheel 45 and a magneto device 46 for generating electricity are provided on this projecting part 44, and are covered by a magneto cover 47.

Figure 6:
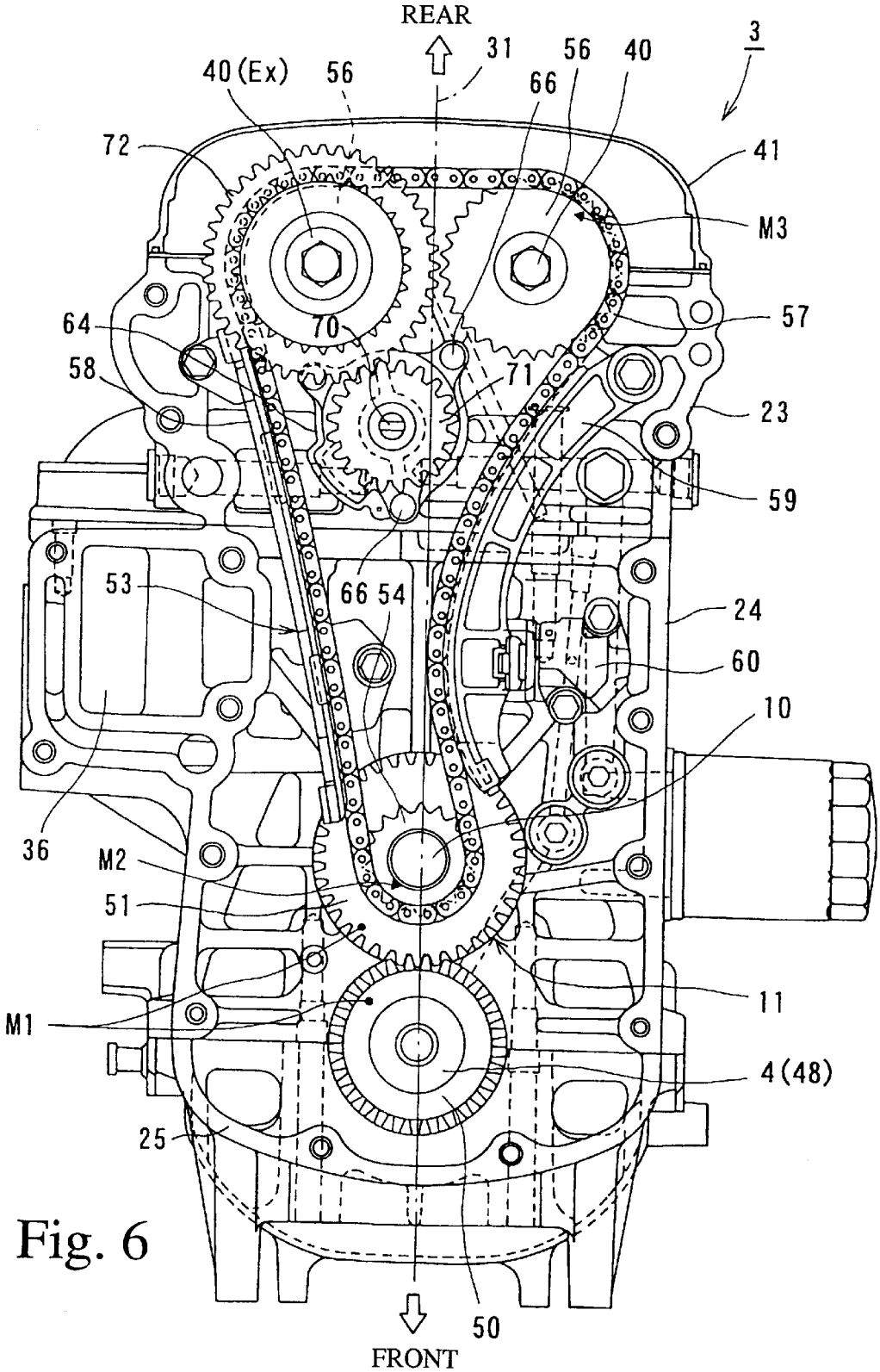
FIG. 6 is a view as shown by arrow VI in FIG. 5 (bottom view of engine).

FIG. 5 is an enlarged vertical cross-sectional view of the engine holder 2 and components in the vicinity thereof shown in FIG. 3, and FIG. 6 is a view by arrow VI in FIG. 5, i.e., a bottom view of the engine 3. As shown in FIGS. 3, 5, and 6, the crankshaft 4 and the drive shaft 10 are disposed with their respective shaft centers offset from each other. As shown in detail in FIG. 6, the shaft centers of the crankshaft 4 and the drive shaft 10 are aligned on the axis 31 of the cylinder 29 in plan view. Here, the plan view may include a cross section projected on the same plane or any cross sectional view may be superimposed on an original plan view to make the plan view. Thus, in the present embodiment, each cylinder axis line 31 may converge single line on in the plan view, and the crankshaft center and the drive shaft center are disposed on the single line 31 as shown in FIG. 4. The shaft center of the drive shaft 10 is disposed offset toward the rear (toward the cylinder head 23) from the shaft center of the crankshaft 4. In the present embodiment, "toward the rear" means "toward the right" in FIGS. 1, 2 and 3.

Thus, in the embodiment, the drive shaft 10 extends downward from the bottom of the engine 3 while the crankshaft 4 extends upward from the bottom of the engine 3 such that the top portion of the drive shaft 10 is operatively linked to the bottom portion of the crank shaft 4 by way of the connecting means 1. Both drive shaft 10 and crankshaft 4 are substantially contained in the center plane of the engine 3 where the center plane may cut each cylinder 29 in half along the axial direction of the cylinder 29 so that the axis 31 of the cylinder 29 is also contained in the center plane of the engine 3.

Furthermore, in the case of the inline four-cylinder engine 3 shown in this embodiment, the axis 31 of the cylinder 29, in plan view, coincides with the center line of the engine 3, which extends in the front-rear direction of the outboard motor 1 and passes through the shaft center of the crankshaft 4.

If the engine 3 is substantially symmetric in weight with respect to the center plane, it is likely that the center line of the outboard motor and/or a CG line which passes the center of gravity (CG) of the outboard motor 1 and extends in the longitudinal or the front-rear direction of the outboard motor 1 may coincide with the cylinder axis 29 in plan view.

Then, the above-mentioned mounting device 6 is disposed in space directly beneath the crankshaft 4, which is created by offsetting the drive shaft 10 rearward from the shaft center of the crankshaft 4, and a pilot shaft 18, which constitutes this mounting device 6, is disposed practically on a coaxial line with the crankshaft 4 (Refer to FIG. 5). Thus, the shaft center of the pilot shaft 18 may practically coincide with the shaft center of the crankshaft 4 in plan view.

In the embodiment, as mentioned above, the distance between the shaft centers of the crankshaft 4 and the drive shaft 10 is long enough to create the space for the mounting device 6 under the crankshaft 4. However, the distance between the shaft centers of the crankshaft 4 and the drive shaft 10 may be shorter.

The bottom end of the crankshaft 4 protrudes below the engine 3 (or the crank case and the cylinder block 24). A crank gear 50 whose phase is adjusted by a knock-pin 49 is press-fitted onto this protruding portion 48. The above-mentioned connecting means 11 is, for example, engaged coaxially with the drive shaft 10 by means of a spline at the top end of the drive shaft 10, which protrudes above the engine holder 2. A driven gear 51, which engages with the above-mentioned crank gear 50, is integrally formed into this connecting means 11. Furthermore, the top and bottom ends of this connecting means 11 are supported, respectively, by the cylinder block 24 and the engine holder 2 by way of, for example, ball bearings 52.

Then, as the crankshaft 4 rotates, the rotational force thereof is transmitted from the is crank gear 50 to the driven gear 51, whereby the rotational drive is applied to the drive shaft 10. Note that although the crank gear 50 and the driven gear 51 are not illustrated in detail, they are for example "helical gears" whose twisting direction is such that, when the engine 3 is turning in the normal direction, the crankshaft 4 and the drive shaft 10 generate thrust forces in upward and downward directions, respectively. Also, the driven gear 51 is provided with a greater number of teeth than the crank gear 50, whereby the drive shaft 10 is rotationally driven at a lower speed than the crankshaft 4. Note that phase alignment marks M1 for the crank gear 50 and the driven gear 51 are respectively provided on the lower surfaces (toward the engine holder 2) of these gears 50 and 51.

In the space between the lower part of the engine 3 and the upper surface of the engine holder 2, a camshaft drive mechanism 53 is provided which transmits the rotation of the crankshaft 4 to the camshaft 40, thereby rotationally driving the camshaft 40. This camshaft drive mechanism 53 (e.g., a chain drive mechanism) comprises a timing sprocket 54 which is formed integrally with the above-mentioned connecting means (or linking means) 11 below the driven gear 51 formed into the linking means 11, a pair of left and right (intake and exhaust) cam sprockets 56 which are provided at the bottom end of the two camshafts 40 projecting from the lower surface of the engine 3 and whose phase is aligned by a knock-pin 55 so that they rotate integrally, and a timing chain 57 which is wrapped around the outside of these sprockets 54 and 56. The ratio of the number of teeth in the timing sprocket 54 to the number of teeth in the cam sprocket 56 is set to greater than 1:2 (i.e., the speed conversion ratio is less than 2 to 1 (or 2/1)). The number of teeth on each gear and sprocket is set so that the final ratio of rotational speeds of the crankshaft 4 and the camshaft 40 becomes 2:1.

A chain guide 58 and a chain tensioner 59 provided at the lower surface of the engine 3 ensure that the free play and tension in timing chain 57 are always suitable. The Chain guide 58 is disposed on the tensioned side (exhaust side) of the timing chain 57 and is fixed astride the lower surfaces of the cylinder head 23 and the cylinder block 24. The chain tensioner 59 is disposed on the relaxed side (air intake side) of the timing chain 57, one end of which is pivoted with rotational freedom at the lower surface of cylinder head 23 so that the tension is adjusted by a tension adjuster 60 provided at the lower surface of the cylinder block 24, whereby the chain tensioner 59 is pushed toward the timing chain 57. An alignment mark M2 for the timing chain 57 is provided at the lower surface (toward engine holder 2) of the timing sprocket 54. Also, an alignment mark M3 for the timing chain 57 is similarly provided at the lower surface (toward the engine holder 2) of the cam sprocket 56.

Incidentally, the camshaft drive mechanism 53 in the above-mentioned embodiment is configured so that the linking means 11 and the camshaft 40 are respectively provided with the timing sprocket 54 and the cam sprocket 56, and that the timing chain 57 is wrapped around these sprockets 54 and 56. According to the present invention, pulleys (not illustrated) instead the sprockets 54 and 56 may be used. And a timing belt (not illustrated) instead the timing chain 57 may be used.

An oil pump 64 is disposed in the space enclosed by the timing chain 57 below the engine 3. The oil pump 64 may, for example, be an ordinary trochoid pump. By way of example, it may be fixed with bolts 66 or the like to the lower surface of the cylinder head 23, with a pump drive shaft 70 projecting below the oil pump 64. A pump driven gear 71 is then provided at the projecting end of this pump drive shaft 70. A pump drive gear 72 is provided at the bottom end of one of the two camshafts, the exhaust camshaft 40 (Ex) in the present embodiment, so as to rotate integrally with the above-mentioned exhaust cam sprocket 56. This pump drive gear 72 is operationally linked to the pump driven gear 71.

The pump drive gear 72 is provided with a greater number of teeth than the pump driven gear 71 so as to drive the pump drive shaft 70 at a greater speed than the camshaft 40.

The operation of this embodiment will be explained hereinbelow.

When the engine 3 starts up, the crankshaft 4 rotates and the drive shaft 10 is driven via the linking means 11. The rotation of the linking means 11 also drives the camshaft 40 via the timing chain 57, whereby the air intake valves 38 and the exhaust valves 39 are opened and closed and the fuel pump 42 is also driven.

The oil pump 64 is driven by the rotation of the camshaft 40, whereby the lubricating oil inside the oil pan 5 is sent under pressure to the engine 3

Since the shaft center of the drive shaft 10 is disposed offset from the shaft center of the crankshaft 4 rearward (toward the cylinder head 23) with both shaft centers of the crankshaft 4 and the drive shaft 10 aligned on the axis line 31 of the cylinder 29 in plan view, space is created directly below the crankshaft 4 and in front of the engine holder 2 and the oil pan 5 so that the mounting device 6 comprising the swivel bracket 17, the mount bracket and the pilot shaft 18 can be disposed in such space. Therefore, the fore-aft length of the overall outboard motor 1 may be shortened to make the outboard motor 1 more compactly.

Further, by shortening the fore-aft length of the overall outboard motor 1, the distance between the center of gravity (CG) of the outboard motor 1 and the shaft center of the pilot shaft 18, which is the horizontal axis of rotation of the outboard motor 1, is reduced (Refer to FIG. 5). Therefore, the control stability of the outboard motor 1 can be enhanced.

Further, by shortening the fore-aft length of the overall outboard motor 1, the left and the right upper mount units 21 disposed in the front portion of the engine holder 2 may be in the vicinity of the center of gravity (CG) of the outboard motor 1 (Refer to FIG. 5) so as to greatly reduce the vibration transmitted from the engine 3 to the hull.

By disposing the timing sprocket 54 for driving the valve camshaft 40 on the bottom side of the engine 3, the distance between the uppermost metal bearing 28 of the crankshaft 4 and the flywheel 45 may be shortened. Therefore, vibration of the engine 3 may be reduced. Furthermore, the up-down length (height) of the overall engine 3 could be shortened so as to make the outboard motor 1 compactly.

By disposing the timing sprocket 54 for driving the camshaft 40 coaxially with the drive shaft 10 on the connecting means 11, which is operationally connected to the crankshaft 4, and the drive shaft 10, which is disposed offset toward the cylinder head 23 from the crankshaft 4, the ratio of the number of teeth of the timing sprocket 54 and the number of teeth of the cam sprocket 56 can be set greater than 1 to 2 without using intermediate members such as an idle shaft and an idle gear available in the prior art. Therefore, the size (or diameter) of the cam sprocket 56 may be reduced so as to make the planar configuration of the cylinder head 23 and the cylinder head cover 41 smaller.

For the engine 3 having two camshafts 40 as shown in this embodiment, by reducing the size (or the diameter) of the cam sprocket 56, the distance between the two camshafts 40 can be made shorter so that the planar configuration of the cylinder head 23 and the cylinder head cover 41 can be made smaller. Further, as shown in FIG. 4, it is also possible to reduce the included angle 99 of the intake valve 38 and the exhaust valve 39 so that reduction of the combustion chamber 33 in size can be made so as to improve the performance of the engine 3.

Furthermore, if the driven gear 51 is formed above the timing sprocket 54 when the driven gear 51 and the timing sprocket 54 are formed integrally into connecting means 11, the crank gear 50, which engages with the driven gear 51, can be disposed higher so that the distance between this crank gear 50 and the metal bearing 28 for pivoting the bottommost portion of the crankshaft 4 can be shortened. Thus, the up-down length (height) of the front portion of the engine 3 can be shortened so that the outboard motor 1 can be compact.

If the timing sprocket 54 is formed above the driven gear 51 (not shown in detail) when the driven gear 51 and the timing sprocket 54 are integrally formed into the connecting means 11, the cam sprocket 56, which may be operationally connected to the timing sprocket 54, can be disposed higher so that the camshaft 40 can be shortened. Thus, it is possible to shorten the up-down length (height) of the rear portion of the engine 3 so that the outboard motor 1 can be compact.

Further, by integrally forming the driven gear 51 and the timing sprocket 54 to the connecting means 11, the number of parts and the number of assembly processes can be reduced. In addition, the overall size can be compact so that the integrally formed parts may fit in smaller space and that the engine 3 can be more compact.

Still further, press-fitting the crank gear 50 onto the bottom end of the crankshaft 4 does not required nuts and other fastening members utilized in the prior art. Therefore, the number of parts, weight and the number of assembly processes can be reduced as well as required peripheral space may be reduced so that the engine 3 can be more compact.

Incidentally, in the above-described embodiment, by way of an example, the engine 3 in which two valve camshafts 4 are used to open and close the intake valve 38 and the exhaust valve 39 is shown. But the present invention can also be applied to an engine (not shown in the figures) of a type, which has one camshaft to open and close both valves.

Further, in the above-described embodiment, by way of an example, the engine 3 is an inline four-cylinder engine, but the present invention can also be applied to an engine with any number of cylinders. Furthermore, the present invention can also be applied to a so-called V-type engine, in which a plurality of cylinders are arranged in V-shape in plan view. In this case, the shaft centers of the crankshaft and the drive shaft are not aligned on the axis 31 of the cylinder 29 in the plan view as with the inline engine 3 described above, but are aligned on the central line of the engine, which extends in the fore-aft direction of the outboard motor and passes through the shaft center of the crankshaft.

CONCLUSION

As explained hereinabove, according to the present invention, a four-cycle outboard motor having a crankshaft disposed substantially vertically within an engine, wherein the rotational force of this crankshaft is transmitted to a propulsion unit via a drive shaft, comprises a crankshaft and a drive shaft with the shaft centers of the crankshaft and the drive shaft disposed in the plan view either on an axis of a cylinder constituting the engine or on the center line of the engine, which extends in the fore-aft direction of the outboard motor and passes through the shaft center of the above-mentioned crankshaft, wherein the shaft center of the drive shaft is arranged offset toward the rear of the outboard motor from the shaft center of the crankshaft. Therefore, according to the present invention, the fore-aft length of the overall outboard motor can be shortened and the outboard motor can be more compact. In addition, control stability is enhanced and vibration is greatly reduced.

Further, according to the present invention, an outboard motor having a crankshaft arranged substantially vertically within an engine, wherein the rotational force of this crankshaft is transmitted to a propulsion unit via a drive shaft, comprises a crankshaft and a drive shaft with the shaft center of the drive shaft disposed offset toward the rear of the outboard motor from the shaft center of the crankshaft, wherein either valve camshaft driving sprocket or pulley is arranged lower than the axis of the bottommost cylinder constituting the engine and wherein either the sprocket or pulley is arranged coaxially with the drive shaft, so that the diameter of the cam sprocket can be reduce and that the outboard motor can be compact.

Furthermore, because the shaft centers of the crankshaft and the drive shaft are arranged, in the plan view, either on the axis of the cylinder constituting the engine or on the center line of the engine, which extends in the fore-aft direction of the outboard motor and which passes through the shaft center of the crankshaft, the outboard motor may be more compact according to the present invention.

And furthermore, because the speed conversion ratio of a first rotational force transmitting member and a second rotational force transmitting member is set less than 2 to 1, the diameter of the cam sprocket may be made smaller so that the outboard motor can be more compact. Here, the speed conversion ratio may be typically defined by the ratio of the number of teeth of the sprocket disposed on the valve camshaft and the number of teeth of the valve camshaft driving sprocket disposed coaxially with the drive shaft if sprockets are used. It may also be defined the ratio of a circumference of pulleys disposed on the valve camshaft and a circumference of a valve camshaft driving pulley disposed coaxially with the drive shaft if pulleys are used.

Then, because the valve camshaft, according to the present invention, comprises one camshaft for intake and one for exhaust, the engine performance may be improved according to the present invention.

And further, according to the present invention, because the crankshaft and the drive shaft are connected by way of the connecting means, because the crank gear is disposed on the bottom end of the crankshaft, because the driven gear, with which the crank gear engages, is integrally formed to the connecting means, and because the valve camshaft driving sprocket or pulley is integrally formed to the connecting means, the number of parts can be reduced and the outboard motor can be more compact.

Further, because the valve camshaft driving sprocket or pulley is arranged below the driven gear, according to the present invention, the up-down length (height) of the engine front portion can be shortened so that the outboard motor can be more compact.

And further, because the valve camshaft driving sprocket or pulley is arranged above the driven gear, according to the present invention, the up-down length (height) of the engine rear portion can be shortened so that the outboard motor can be more compact Still further, because the crank gear is pressed onto the bottom end of the crankshaft, according to the present invention, the number of parts, weight and the number of assembly processes can be reduced and that the outboard motor can be more compact.

What is claimed is:

1. A four-cycle outboard motor having a crankshaft disposed substantially vertically within an engine, rotational force of the crankshaft being transmitted to a propulsion unit via a drive shaft, the shaft center of the drive shaft being offset toward the rear of the outboard motor from the shaft center of the crankshaft, comprising:

a first rotational force transmitting member for driving a valve camshaft disposed coaxially with the drive shaft, wherein the first rotational force transmitting member for driving a valve camshaft is disposed lower than an axis of the bottommost cylinder constituting the engine.

2. The four-cycle outboard motor according to claim 1, wherein the shaft centers of the crankshaft and the drive shaft are disposed in plan view on an axis of a cylinder constituting the engine.

3. The four-cycle outboard motor according to claim 2, further comprising a second rotational force transmitting member disposed on the valve camshaft, wherein a speed conversion ratio of the first rotational force transmitting member and the second rotational force transmitting member is set less than 2 to 1.

4. The four-cycle outboard motor according to claim 3, wherein the crankshaft and the drive shaft are connected by way of connecting means;

wherein a crank gear is disposed at the bottom end of the crankshaft;

wherein a driven gear, with which the crank gear engages, is integrally formed into the connecting means; and wherein the first rotational force transmitting member is integrally formed with the connecting means.

5. The four-cycle outboard motor according to claim 2, wherein the crankshaft and the drive shaft are connected by way of connecting means;

wherein a crank gear is disposed at the bottom end of the crankshaft;

wherein a driven gear, with which the crank gear engages, is integrally formed into the connecting means; and wherein the first rotational force transmitting member is integrally formed with the connecting means.

6. The four-cycle outboard motor according to claim 3, wherein the valve camshaft comprises a first camshaft for an intake valve and a second camshaft for an exhaust valve.

7. The four-cycle outboard motor according to claim 6, wherein the first rotational force transmitting member is disposed below a driven gear.

8. The four-cycle outboard motor according to claim 6, wherein a crank gear is press-fitted onto the bottom end of the crank shaft.

9. The four-cycle outboard motor according to claim 1, further comprising a second rotational force transmitting member disposed on the valve camshaft, wherein a speed conversion ratio of the first rotational force transmitting member and the second rotational force transmitting member is set less than 2 to 1.

10. The four-cycle outboard motor according to claim 9, wherein the valve camshaft comprises a first camshaft for an intake valve and a second camshaft for an exhaust valve.

11. The four-cycle outboard motor according to claim 9, wherein the crankshaft and the drive shaft are connected by way of connecting means;

wherein a crank gear is disposed at the bottom end of the crankshaft;

wherein a driven gear, with which the crank gear engages, is integrally formed into the connecting means; and wherein the first rotational force transmitting member is integrally formed with the connecting means.

12. The four-cycle outboard motor according to claim 1, wherein the crankshaft and the drive shaft are connected by way of connecting means;

wherein a crank gear is disposed at the bottom end of the crankshaft;

wherein a driven gear, with which the crank gear engages, is integrally formed into the connecting means; and wherein the first rotational force transmitting member is integrally formed with the connecting means.

13. The four-cycle outboard motor according to claim 1, wherein the shaft centers of the crankshaft and the drive shaft are disposed in plan view on the center line of the engine, which extends in the fore-aft direction of the outboard motor and passes through the shaft center of the crankshaft.

14. The four-cycle outboard motor according to claim 13, further comprising a second rotational force transmitting member disposed on the valve camshaft, wherein a speed conversion ratio of the first rotational force transmitting member and the second rotational force transmitting member is set less than 2 to 1.

15. The four-cycle outboard motor having a crankshaft disposed substantially vertically with an engine, a rotational force of the crankshaft being transmitted to a propulsion unit via a drive shaft, the outboard motor being characterized:

in that the shaft centers of the crank shaft and the drive shaft are in plan view disposed on an axis of a cylinder constituting the engine;

in that the shaft center of the drive shaft is disposed offset toward the rear of the outboard motor from the shaft center of the crank shaft;

wherein the crank shaft and the drive shaft are connected by way of connecting means;

wherein a crank gear is disposed at the bottom end of the crank shaft;

wherein a driven gear, with which the crank gear engages, is integrally formed into the connecting means; and wherein a first rotational force transmitting member is integrally formed with the connecting means.

16. The four-cycle outboard motor having a crankshaft disposed substantially vertically with an engine, a rotational force of the crankshaft being transmitted to a propulsion unit via a drive shaft, the outboard motor being characterized:

in that the shaft centers of the crank shaft and the drive shaft are in plan view disposed on an axis of a cylinder constituting the engine;

in that the shaft center of the drive shaft is disposed offset toward the rear of the outboard motor from the shaft center of the crank shaft;

wherein the centerline of the engine coincides in plan view with an axis of a cylinder constituting the engine;

wherein the crank shaft and the drive shaft are connected by way of connecting means;

wherein a crank gear is disposed at the bottom end of the crank shaft;

wherein a driven gear, with which the crank gear engages, is integrally formed into the connecting means; and wherein a first rotational force transmitting member is integrally formed with the connecting means.

17. The four-cycle outboard motor having a crankshaft disposed substantially vertically with an engine, a rotational force of the crankshaft being transmitted to a propulsion unit via a drive shaft, the outboard motor being characterized:

in that the shaft centers of the crank shaft and the drive shaft are in plan view disposed on an axis of a cylinder constituting the engine;

in that the shaft center of the drive shaft is disposed offset toward the rear of the outboard motor from the shaft center of the cram shaft;

wherein the crank shaft and the drive shaft are connected by way of connecting means;

wherein a crank gear is disposed at the bottom end of the crank shaft;

wherein a driven gear, with which the crank gear engages, is integrally formed into the connecting means; and wherein a first rotational force transmitting member is integrally formed with the connecting means.

18. The four-cycle outboard motor having a crankshaft disposed substantially vertically with an engine, a rotational force of the crankshaft being transmitted to a propulsion unit via a drive shaft, the outboard motor being characterized:

in that the shaft centers of the crank shaft and the drive shaft are in plan view disposed on a CG line in the fore-aft direction of the outboard motor passing through the center of gravity of the outboard motor, in that the shaft center of the drive shaft is disposed offset toward the rear of the outboard motor from the shaft center of the crank shaft;

wherein the CG line in plain view coincides with an axis of a cylinder constituting the engine;

wherein the crank shaft and the drive shaft are connected by way of connecting means;

wherein a crank gear is disposed at the bottom end of the crank shaft;

wherein a driven gear, with which the crank gear engages, is integrally formed into the connecting means; and wherein a first rotational force transmitting member is integrally formed with the connecting means.

* * * * *